US005324911A

United States Patent [19]

Cranston et al.

[11] Patent Number: 5,324,911

[45] Date of Patent: Jun. 28, 1994

[54] HEATED ANIMAL SURGERY TABLE

[75] Inventors: Dale O. Cranston, Baldwin City, Kans.; Richard N. Cartwright, Independence, Mo.

[73] Assignee: Schroer Manufacturing Company, Kansas City, Mo.

[21] Appl. No.: 859,937

[22] Filed: Mar. 30, 1992

Related U.S. Application Data

[63] Continuation of Ser. No. 462,066, Jan. 8, 1990, abandoned.

[51] Int. Cl.[5] ..... H05B 3/06

[52] U.S. Cl. ..... 219/218; 219/521; 5/601

[58] Field of Search ..... 219/218, 217, 521; 5/601, 600; 128/376

[56] References Cited

U.S. PATENT DOCUMENTS

| | | | |
|---|---|---|---|
| 1,648,631 | 11/1927 | Austin . | |
| 1,947,801 | 2/1934 | Russell . | |
| 1,980,848 | 11/1934 | Cass | 5/601 |
| 2,471,884 | 5/1949 | Monnot . | |
| 2,504,697 | 4/1950 | Kearsley . | |
| 3,217,672 | 11/1965 | Haughey . | |
| 3,285,207 | 11/1966 | Vom Hagen . | |
| 3,420,981 | 1/1969 | Martinet . | |
| 3,617,693 | 11/1971 | Shimosawa . | |
| 3,771,782 | 11/1971 | Anderegg . | |
| 4,491,173 | 1/1985 | Demand . | |
| 4,666,923 | 5/1987 | Hölck et al. . | |
| 4,788,417 | 11/1988 | Graflind | 219/528 |
| 5,138,138 | 8/1992 | Theilacker et al. | 219/218 |

FOREIGN PATENT DOCUMENTS

| | | | |
|---|---|---|---|
| 509683 | 2/1955 | Canada . | |
| 840028 | 8/1952 | Fed. Rep. of Germany . | |
| 2056425 | 5/1972 | Fed. Rep. of Germany . | |
| 2308214 | 8/1974 | Fed. Rep. of Germany . | |
| 735719 | of 0000 | France | 219/218 |
| 563028 | 9/1923 | France . | |
| 573303 | 6/1924 | France | 219/218 |
| 670278 | 4/1952 | United Kingdom | 219/218 |

OTHER PUBLICATIONS

T. Joergensen, Operating Table Controlling Water Balance and Temperature of Cats, Institute of Medical Physiology C. University of Copenhagen, Copenhagen, Denmark, Sep. 24, 1971.

*Primary Examiner*—Philip H. Leung
*Assistant Examiner*—John A. Jeffery
*Attorney, Agent, or Firm*—Wm. Bruce Day

[57] ABSTRACT

An animal surgery table having an electrical heating pad disposed immediately beneath the operating surface and thermostatically controlled by a temperature sensor embedded within the heating pad for preventing heat loss from animals during surgery is disclosed.

2 Claims, 1 Drawing Sheet

HEATED ANIMAL SURGERY TABLE

This is a continuation of application Ser. No. 07/462,066, filed Jan. 8, 1990, now abandoned.

BACKGROUND OF THE INVENTION

1. Field of the Invention

This invention relates to heated animal surgery tables.

2. Description of the Related Art

Animal surgery tables are well known in the prior art. The upper, or supporting surface, of animal surgery tables is typically stainless steel, which can be cleaned and sterilized easier than most surfaces. Accordingly, they are well suited to use during surgery.

Although widely used, such tables present a significant problem in use. Stainless steel is a good conductor of heat and consequently draws body heat out of the animal during surgery. Studies demonstrate that the resulting heat loss typically drops the animal's body temperature by about 2° F. (1.11° C.). When an animal's body temperature drops, its heart rate increases, increasing the loss of blood and the general stress on the animal. This thermal loss can result in hypothermia, increases the trauma and stress on the animal, increases the mortality rate from surgery and from certain types of illness or injury, increases recovery time and reduces metabolism.

Rags are sometimes wrapped around the animal to reduce the heat loss, but the practice is largely ineffective for this purpose. The practice is also unsanitary and can interfar with the surgery.

Accordingly, there is a need for an animal surgery table that does not draw heat away from the animal during surgery.

SUMMARY OF THE INVENTION

Accordingly, it is the primary object of the present invention to provide an animal surgery table that does not draw heat from the animal during surgery.

Accordingly, the present invention provides a heated surgery table having an electrical heating pad embedded in the tabletop directly beneath and in contact with the stainless steel upper surface of the surgery table. The temperature of the heating element is controlled by an in-line precision temperature sensor comprising a platinum resistor, whose signal is processed by electrical equipment that determines when the heating pad should be turned on to maintain the temperature of the tabletop at a specified predetermined setting.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

As required, a detailed embodiment of the present invention is disclosed herein. It is, however, to be understood that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriate detailed structure.

Figure 1:
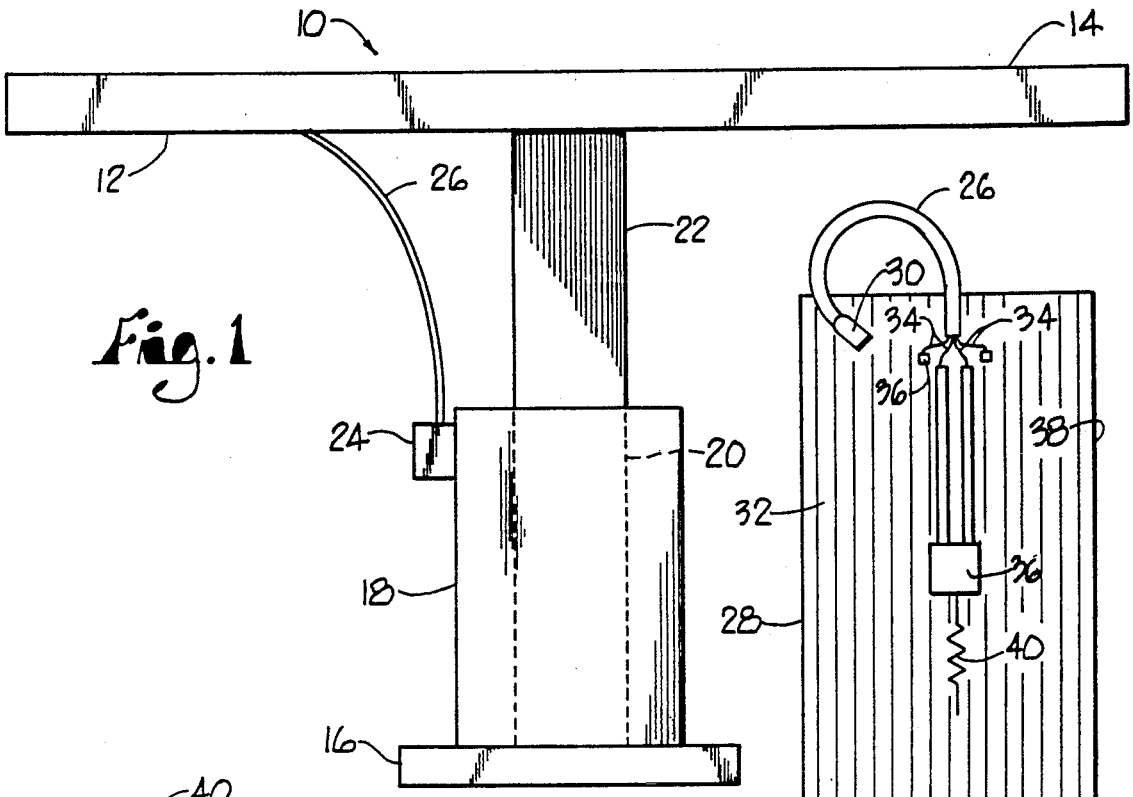
FIG. 1 is a side elevation of an animal surgery table according to the present invention.

Referring to FIG. 1, there is shown the animal surgery table 10 comprising a top 12 having a stainless steel upper surface 14, and a base 16, which supports a stationary pedestal 18. The pedestal 18 includes a bore 20 for receiving a moveable column 22, which is hydraulically moveable through use of a foot petal to raise and lower the top 12 to a convenient working height. The table 10 further includes a control box 24 connected to a cable 26 for controlling the temperature of the tabletop, as described in detail below.

Figure 2:
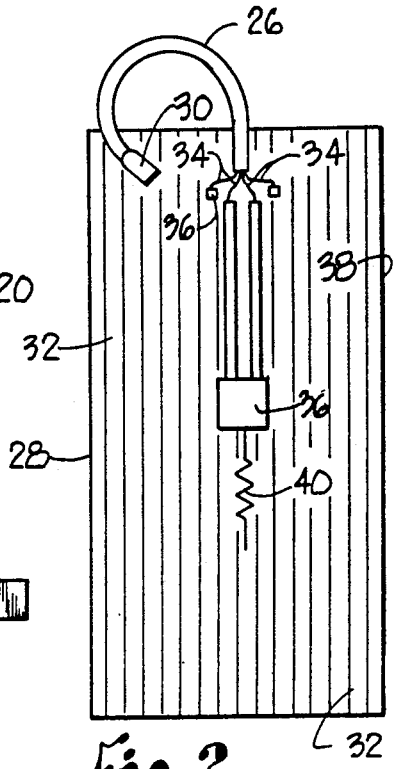
FIG. 2 is a bottom plan view of the heating pad assembly of the table in FIG. 1.

Referring to FIG. 2, there is shown a heating pad 28 having a jacketed or sheathed cable 26 terminating in a four-wire connector 30 for plugging into the combination control and power box 24. The heating pad 28 includes four conductors for making two complete electrical circuits in the heating elements 32. Conducting wires 34 are fastened to the heating pad 28 by tape fasteners 36 or other convenient means. The heating pad 28 comprises two layers of sheeting 38 with the heating element 32 sandwiched between them and sealed therein, by, for example, heating the plastic. The heating elements 32 which form a grid in the heating pad 28, are made of electrical resistance wire, preferably nichrome, that is, an alloy of approximately 62 percent nickel, 15 percent chromium and 23 percent iron. in the preferred embodiment, the nichrome is approximately 80 percent nickel and 20 percent chromium. The hearing elements 38 are designed to operate on 120 volts alternating current at 50–60 Hertz (Hz) and have a heat rating of 0.25 watts per square inch (0.037 per square centimeter). The sheeting 38 is preferably Mylar backed fiberglass sheeting having a temperature rating of at least 155° C. A resistor 40 is a 1,000 ohm platinum resistor with an alpha of 385 (3.85 ohms per ohm per ° C.) for sensing the surface temperature of the upper surface 14 of the tabletop 12. This provides precise control of the temperature on the work surface without any intervening ambient conditions such as the air in the room that the use of a conventional thermostat would involve.

Figure 3:
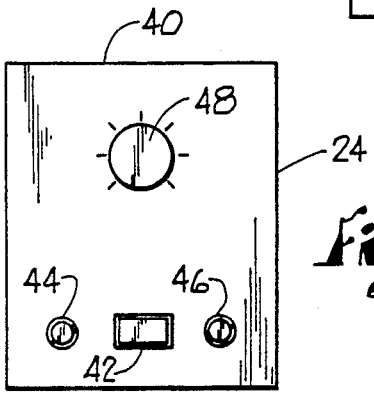
FIG. 3 is a front elevation of the control box for the heating pad.

Referring to FIG. 3, the control box 24 includes a display panel 40 which supports a power switch 42, a power indicator light 44 (which comes on when the power is turned on), a heat indicator lamp 46, and a temperature setting dial 48, which allows the doctor or assistant to set the temperature from about 70° F. (21° C.) to about 108° F. (42° C.). The control box 24 also includes appropriate electronic devices for switching the electrical power supply to the heating elements 32 on and off in response to the signals from the resistor 40 and the setting on the temperature setting dial 48.

Figure 4:
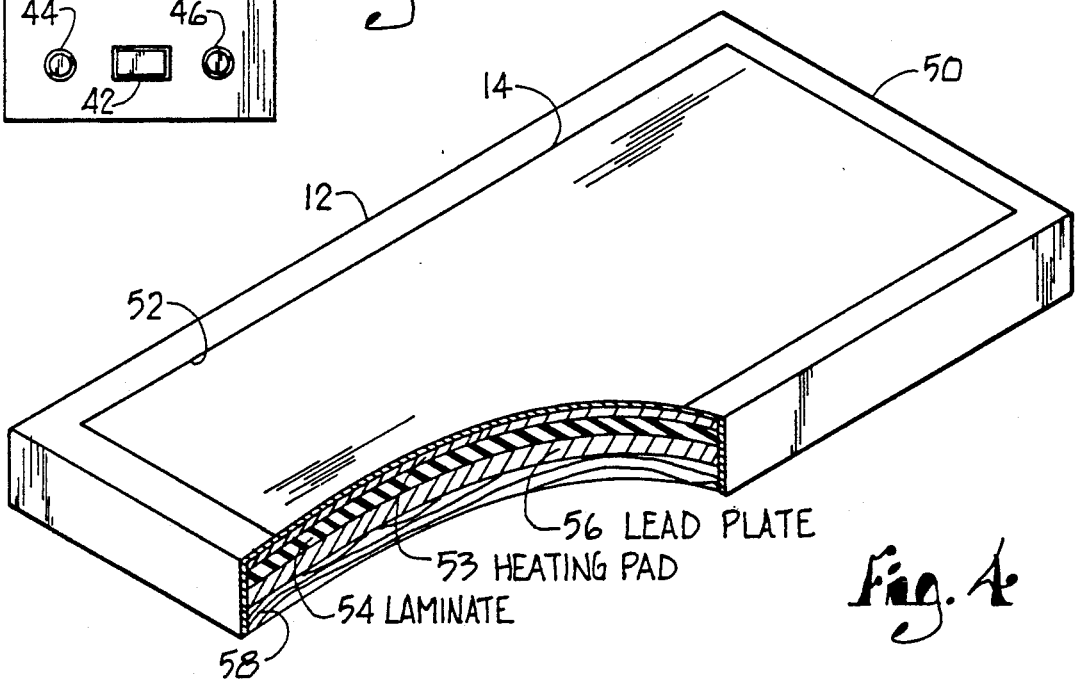
FIG. 4 is an isometric view of the tabletop in an upright position illustrating the layers of material in it.

Referring to FIG. 4, there is shown an isometric view, partially in section, of the top 12 oriented with the upper surface facing upward. The top 12 is a composite layered top comprising five layers. Beginning with the upper surface, is a stainless steel upper surface 52 upon which the animal is placed during surgery. Directly beneath it is a heating pad assembly 53 (see FIG. 2), under which is a laminate 54, for protecting and stiffening the heating pad assembly 53. Under the laminate 54 is a lead plate 56 for stopping X-rays. The lead plate 56 is 0.039 inches (1 mm) thick. Providing rigidity and stability to the entire assembly is a wood base 58. These five layers of materials are held together in compression by a frame 58. This structure permits replacement of the heating pad 28 with about fifteen minutes of labor.

It is to be understood that While certain forms of this invention have been illustrated and desdribed, it is not limited thereto, except insofar as. such limitations are included in the following claims.

What is claimed and desired to be secured by Letters Patent is as follows:

1. A veterinary surgery and examination table comprising:

a. a substantially planar, moisture impervious thermally conductive metal top panel have a raised peripheral rim for containment of bodily fluids;

b. said top panel having a downwardly extending peripheral flange;

c. a heating pad having top and bottom insulating sheeting layers and a middle grid of electrically resistive conductors, said heating pad being positioned flush against an undersurface of said top panel and extending substantially continuously thereunder for even heating of said top panel throughout its area;

d. a lead shield sheet extending under said heating pad for stopping X-rays;

e. a bottom sheet member extending under said lead shield sheet, with said heating pad, said lead shield sheet and said bottom sheet member all contained within said peripheral flange;

f. a support column center mounted under said top panel and having a foot end for positioning on a floor surface and an upper end mounted to said bottom sheet, said support column having telescopically extensible memebrs and including means for telescoping extension of said members; and g. a control box operably connected to said heating pad and including a temperature setting dial and an on/off switch for routing electrical current to said heating pad.

2. A veterinary surgery and examination table comprising:

a. a substantially planar, moisture impervious, top panel of thermally conductive metal and having a raised peripheral rim for containment of bodily fluids;

b. said top panel having a downwardly extending peripheral flange;

c. a heating pad having top and bottom insulative sheeting layers and a middle grid of electrically resistive conductors, said top sheeting layer having a temperature sensing resistive element therein, said heating pad being positioned flush against an undersurface of said top panel and extending substantially continuously thereunder for even heating of said top panel and with said temperature sensing resistance element in substantially direct contact with said top panel undersurface for direct temperature sensing;

d. a bottom sheet member extending under said top panel with said heating pad and said bottom sheet member all contained within said peripheral flange;

e. a support column center mounted under said top panel and having a foot end for positioning upon a floor surface and an upper end mounted to said bottom sheet, said support column having telescopically extensible members and including means for telescopic extension of said members; and f. a control box operably connected to said heating pad and including a temperature sensing dial operably connected to said temperature sensing resistive element, and an on/off switch for routing electrical current to said heating pad.

* * * * *